US005628874A

United States Patent [19]

Lindberg et al.

[11] Patent Number: 5,628,874

[45] Date of Patent: May 13, 1997

[54] REDUCTION OF CHLORIDE IN PULPING CHEMICAL RECOVERY SYSTEMS

[75] Inventors: Hans Lindberg, Stockholm; Birgitta Sundblad, Göteborg, both of Sweden

[73] Assignee: Eka Nobel AB, Bohus, Sweden

[21] Appl. No.: 392,761

[22] PCT Filed: Aug. 18, 1993

[86] PCT No.: PCT/SE93/00688

§ 371 Date: Feb. 23, 1995

§ 102(e) Date: Feb. 23, 1995

[87] PCT Pub. No.: WO94/04747

PCT Pub. Date: Mar. 3, 1994

[30] Foreign Application Priority Data

Aug. 24, 1992 [SE] Sweden ..... 9202419-9

[51] Int. Cl.[6] ..... D21C 11/05; D21C 11/12

[52] U.S. Cl. ..... 162/30.1; 162/50; 205/521; 205/536; 205/576

[58] Field of Search ..... 162/29, 30.1, 30.11, 162/50; 204/182.4, 182.5, 301; 205/521, 522, 536, 576

[56] References Cited

U.S. PATENT DOCUMENTS

| | | | |
|---|---|---|---|
| 3,954,579 | 5/1976 | Cook, Jr. et al. | 204/98 |
| 4,133,778 | 1/1979 | Gray | 252/517 |
| 4,277,447 | 7/1981 | Chambers et al. | 423/165 |
| 4,391,680 | 7/1983 | Mani et al. | 204/98 |
| 4,417,961 | 11/1983 | Ezzell et al. | 204/98 |
| 5,139,632 | 8/1992 | Chlanda et al. | 204/182.4 |

FOREIGN PATENT DOCUMENTS 9412723 6/1994 WIPO .

*Primary Examiner*—Donald E. Czaja
*Assistant Examiner*—Dean T. Nguyen
*Attorney, Agent, or Firm*—Burns, Doane, Swecker & Mathis, L.L.P.

[57] ABSTRACT

The present invention relates to an environmental-friendly process for reducing the content of chloride in a liquor inventory of a chemical pulp mill. According to the invention, in a recovery system for pulping chemicals containing sulphur and an alkali metal, precipitator dust formed in a recovery boiler is collected and withdrawn, dissolved in water and electrolyzed for production of chlorine or hydrochloric acid in the anolyte. Since the dust normally contains a large amount of sodium sulphate, sulphuric acid and sodium hydroxide can also be produced in the electrolysis. To reduce the content of impurities, before the electrolysis, the pH of the aqueous solution is adjusted to above about 10 to precipitate inorganic substances which are separated-off together with flocculated or undissolved substances.

10 Claims, 1 Drawing Sheet

REDUCTION OF CHLORIDE IN PULPING CHEMICAL RECOVERY SYSTEMS

The present invention relates to an environmental-friendly process for reducing the content of chloride in a liquor inventory of a chemical pulp mill. According to the invention, in a recovery system for pulping chemicals containing sulphur and an alkali metal, precipitator dust formed in a recovery boiler is collected and withdrawn, dissolved in water and electrolyzed for production of chlorine or hydrochloric acid in the anolyte. Since the dust normally contains a large amount of sodium sulphate, sulphuric acid and sodium hydroxide can also be produced in the electrolysis. To reduce the content of impurities, before the electrolysis, the pH of the aqueous solution is adjusted to above about 10 to precipitate inorganic substances which are separated-off together with flocculated or undissolved substances.

BACKGROUND TO THE INVENTION

In the production of a chemical pulp, chips of lignocellulose-containing material are cooked in an alkaline or acid aqueous solution. This cooking liquor contains inorganic pulping chemicals to improve the dissolution of lignin. The cooking is normally carried out at a temperature above 100° C. to reduce the residence time for the pulp produced. Therefore, the cooking is carried out in a pressure vessel known as a digester.

In the production of sulphate and sulphite pulps with an alkali metal as a base, normally sodium, it is possible to recover the inorganic pulping chemicals in the spent liquor leaving the digester. It is vital both to economy and environment to recover these pulping chemicals to the largest possible extent. This is achieved in the pulping chemical recovery system, which essentially transfers the used inorganic pulping chemicals into a chemical state, where they can be used again for cooking.

An essential part of the recovery system is the recovery boiler, where the spent liquor is burned. Normally, make-up chemicals are added to the spent liquor before the recovery boiler to make up for the chemicals lost during cooking and recovery. The spent liquor is sprayed into the lower part of the boiler, previously at a relatively low temperature to remove free water. Modern recovery boilers operate at a high temperature to reduce the content of sulphur in the flow gases leaving the boiler. Higher up in the boiler, gases and vapors of light hydrocarbons and decomposition products are volatilized. This is known as pyrolysis. Then, the pyrolysis products are burned after mixing with air or oxygen. The solid carbon-based residue which remains after complete pyrolysis of the organics is then heterogeneously burned. The solid particles formed are collected as a dust in precipitators at the top of the recovery boiler, to reduce the release of solid material to the surrounding atmosphere.

A substantial and increasing problem with the pulping chemical recovery system, is the presence of chloride and potassium in the spent liquor entering the recovery boiler. These elements tend to reduce the capacity of the recovery boiler to produce useful chemicals. Thus, chloride and potassium increase the stickiness of carryover deposits and dust particles to the recovery boiler tubes, which accelerate fouling and plugging in the upper part of the recovery boiler. Chloride also tend to increase the corrosion rate of superheater tubes.

Chloride and potassium are concentrated in the dust formed during the combustion of spent liquor in the recovery boiler. The dust is collected in dry-bottom or wet-bottom electrostatic precipitators. The dust mainly consists of sodium and potassium salts, where sulphate, carbonate and chloride are the dominant anions. The amount of dust corresponds to about 5 to 15% of the sodium entering the recovery boiler, which corresponds to about 50 to 150 kg dust per ton pulp, if the dust is calculated as sodium sulphate.

Today, normally all of the precipitator dust collected and withdrawn from the recovery boiler is recycled to the flow of spent liquor to be burned in the boiler. When the concentration of chloride or potassium is too high, a portion of the precipitator dust is withdrawn from the system and discharged or deposited.

The content of chloride in the spent liquor can be very high for coastal mills, if the raw material consists of logs floated in seawater. The content is moderate in mills using caustic make-up contaminated with sodium chloride or in mills that at least partially recover spent bleach liquors from stages using chlorine-containing bleaching agents. As the environmental legislation becomes more stringent as regards pulp mill discharges to air and water, the degree of system closure increases. This means that even a small input of chloride becomes a severe problem, unless the content can be controlled by purging the system in some environmentally acceptable way.

US-A-3 684 672 relates to a process for recovering pulp cooking agents in a recovery boiler system equipped with a precipitator. Dust collected in the precipitator is dissolved in water, acidified with externally produced sulphuric acid and subsequently electrolyzed in a cell to produce chlorine, which is removed at the anode. The lack of pretreatment to remove impurities in the aqueous solution and the use of a cell without separator, will give a poor chloride-removal efficiency and an increasing cell voltage.

SE-A-7503295 relates to a process for removing sodium chloride from precipitator dust by leaching with an aqueous solution. The sodium chloride is separated from the resulting salt-containing solution by cooling or evaporation, at which sodium chloride precipitates.

The invention

The present invention relates to a process by which the content of chloride in a recovery system for pulping chemicals containing sulphur and an alkali metal can be reduced. The process comprises bringing spent liquor to a recovery boiler, burning said spent liquor optionally together with make-up chemicals, collecting precipitator dust formed and withdrawing said precipitator dust, dissolving at least a portion of the precipitator dust in water to produce an aqueous solution of precipitator dust and electrolyzing same aqueous solution, whereby the pH of said aqueous solution is adjusted to above about 10 before the electrolysis to precipitate inorganic substances, in that precipitated, flocculated or undissolved inorganic and organic substances are separated from said aqueous solution, in that subsequently said aqueous solution is electrolyzed in an electrochemical cell containing at least two compartments for production of chlorine or hydrochloric acid in the anode compartment and alkali metal hydroxide in the cathode compartment.

The process of the invention thus concerns an electrochemical process for reducing the content of chloride in a pulp mill recovery system as defined by in the claims. With the present process where the aqueous solution containing precipitator dust is pretreated to remove impurities and subsequently electrolyzed in a cell equipped with at least two compartments, the contents of chloride can be reduced to a considerably lower level than with techniques of the prior art. In this way, the problem of sticky deposits in the recovery boiler can be substantially reduced. This means an improved energy efficiency as well as a higher degree of recovery of the pulping chemicals.

A further advantage of the present process is the possibility to produce chemicals that are useful inside or outside the pulp mill. Depending on the composition of the precipitator dust used and the desired products and their purifies, mainly combinations of sulphuric acid, sodium sulphates, alkali metal hydroxide, hydrochloric acid and chlorine can be produced. In this way, chloride can be removed from the pulp mill essentially without any loss of sodium or sulphur.

Another advantage of the present process is the possibility to reduce the content of potassium in the liquor inventory and more particularly in the spent liquor entering the recovery boiler. This is achieved if at least a portion of the potassium-containing chemicals produced in the cell, are not recycled to the pulping chemical recovery system. Depending on the design of the electrochemical cell and more particularly the choice of membrane, chemicals enriched in potassium can be produced in the anode or cathode compartment of the cell. For example, a Nafion 324 cation exchange membrane can separate the sodium and potassium ions in such a way that the acid anolyte is enriched in potassium.

A prerequisite for the present invention is the use of an alkali metal as base in the pulping chemicals. The alkali metal can be sodium or potassium, suitably sodium. Although the advantages of the present invention can be obtained with potassium-containing pulping chemicals, the invention will be described in the following specification with respect to the use of sodium-containing pulping chemicals. This means that sodium is the main counter ion to the active components of the pulping chemicals.

The present invention can be used in the production of chemical pulps and especially sulphate or sulphite pulps with an alkali metal as base. Suitably, the present process is applied where the recovery system for pulping chemicals containing sulphur and an alkali metal is a sulphate recovery system.

A liquor inventory is the total quantity of various liquors in a mill, with varying contents of active or activatable cooking liquor components. The liquor inventory of a sulphate mill, mainly consists of white liquor, black liquor, green liquor and spent liquor entering the recovery boiler. The spent liquor to be burned in the present process, is a used cooking liquor withdrawn from a digester, optionally with added make-up chemicals.

The amount of precipitator dust formed depends mainly on the temperature in the boiler, the ratio between sodium and sulphur in the spent liquor and the raw material and sulphidity of the cooking process. A high temperature in the lower part of the boiler to reduce the sulphur content in the flow gases, increases the amount of dust formed.

With the present process, all or a portion of the precipitator dust collected and withdrawn from the recovery system is dissolved in water and electrolysed in an electrochemical cell. The proportion between the amount of dust electrolysed and recycled directly to the flow of spent liquor, can be chosen with respect to the initial content of chloride ions in the dust, the desired content of chloride ions in the liquor inventory and the consumption of anolyte for various acidification purposes.

Precipitator dust mainly consists of sodium and potassium salts, where sulphate, carbonate and chloride are the dominant anions. The dust predominantly contains sodium sulphate, typically 80–85 percent by weight. Therefore, under normal conditions sulphuric acid and sodium hydroxide will be produced in the anode and cathode compartment, respectively. The combination of concentration and purity of these products can be varied within wide limits, by selecting suitable conditions under which the electrolysis is carried out. Furthermore, it is suitable to select the conditions in a known manner such that the chloride in the precipitator dust is converted to hydrochloric acid or chlorine in the anode compartment. When chloride is converted to hydrochloric acid in the cell, a mixture of hydrochloric acid and sulphuric acid is obtained in the anolyte. More suitably the conditions are selected such that chlorine is produced. By choosing a suitable combination of type and number of cells and process conditions before and in the electrolysis, the chloride ions initially present in the aqueous solution can be essentially eliminated.

The pH of the aqueous solution of precipitator dust is adjusted to above about 10 before the electrolysis to precipitate inorganic substances which constitute impurities in the subsequent electrochemical process. Calcium, magnesium, iron and manganese are the most important examples of precipitable inorganic impurities present as cations in the aqueous solution. The content of these cations can be reduced down to an acceptable level by raising the pH sufficiently, at which inorganic substances, mainly hydroxides, precipitate. The pH in suitably adjusted to within the range from 10 up to 14 and preferably from 11 up to 13. The pH can be adjusted by adding alkali metal hydroxide or alkali metal carbonate or a combination thereof. Suitably, the pH is adjusted by adding catholyte containing alkali metal hydroxide withdrawn from the electrochemical cell according to the invention.

Precipitated, flocculated or undissolved inorganic and organic substances, which constitute impurities in the subsequent electrochemical process, are separated from the aqueous solution after adjusting the pH to above about 10 and before the electrolysis. The substances can also be separated from the aqueous solution before the pH is adjusted, suitably both before and after the pH has been adjusted. By separating the substances before the pH has been adjusted, mainly substances that remain undissolved from the dissolving step are separated off. By this preseparation, especially the content of zinc is reduced, but also the content of phosphate, aluminium, silicon and vanadium are reduced to a considerable extent. By separating substances after the pH has been adjusted, mainly flocculated organic substances and precipitated inorganic substances are separated off. The precipitated, flocculated or undissolved inorganic and organic substances can be separated from the aqueous solution by any conventional technique, e.g. filtering, centrifugation, sedimentation or flotation.

The aqueous solution of precipitator dust can be cation exchanged before the electrolysis to reduce the content of inorganic impurities. The inorganic impurities comprise compounds containing multivalent cations and especially divalent cations such as calcium, magnesium, iron, manganese, zinc, tin and strontium.

The aqueous solution of precipitator dust can be acidified before the electrolysis to reduce the content of carbonate or carbon dioxide in said aqueous solution, to avoid any negative effects of carbon dioxide in the cell. If carbonate ions are present in the aqueous solution in the electrolysis step, carbon dioxide will be liberated since the anolyte is acid. The pH in the acid step can be in the range up to about 6.5, suitably from 2 up to 6 and preferably from 3 up to 5.

Suitably, the aqueous solution is both ion exchanged and acidified after separating off inorganic and organic substances and before the electrolysis. Preferably, the aqueous solution is acidified with anolyte withdrawn from the electrochemical cell.

Electrochemical cells are well known as such and any conventional cell with at least two compartments can be used in the process of the invention. Principally a two-compartment electrochemical cell contains a cathode, an anode and between them a separator such as a membrane or diaphragm. The use of a separator minimizes the risk of chlorine migration from the anode to the cathode where it can be reduced back to chloride or hydrolysed to chlorate. Thus, with a separator the chloride-reduction efficiency can be markedly improved. Depending on the initial composition of the aqueous solution containing precipitator dust and the desired products of the electrolysis, it can be more advantageous to use a cell with two or more membranes or diaphragms between the electrodes, i.e. a three-compartment cell, four-compartment cell etc.

When chlorine is produced, it is advantageous to use cells where the transport of chloride ions to the anode surface is enhanced. This can be obtained by using a flow-through cell, where the flow of anolyte between the separator and anode is high. The mass transport can be further enhanced by using a turbulence promotor, a so-called spacer, between the separator and anode. A flow-through cell, optionally equipped with a turbulence promotor such as a plastic fabric, makes possible reduction of chloride to very low concentrations and at a high current efficiency, even when the initial concentration of chloride is low. The mass transport of chloride can be further enhanced by using a three-dimensional anode with a high surface area.

With a two-compartment cell, the solution of precipitator dust containing e.g. sodium, sulphate and chloride ions plus water is added to the anode compartment. At the anode, oxygen and protons are produced by water splitting. In the anolyte, the protons combine with the sulphate ions to sulphuric acid and bisulphate and with the chloride ions to hydrochloric acid. At the anode, chlorine gas is formed by oxidation of chloride ions if the formation of chlorine is enhanced. Hydrogen and hydroxyl ions are produced at the cathode. Sodium ions from the solution of precipitator dust migrates through the membrane or diaphragm to the catholyte for production of sodium hydroxide.

The anolyte feed can be passed once through the anode compartment of a single cell. However, the increase in concentration of sulphuric acid will be very limited, even if the anolyte is transferred through the cell at a very low flow rate. Therefore, it is suitable to bring the flow of anolyte withdrawn from the cell to an anode compartment for further electrolysis, until the desired concentration of sulphuric acid and/or alkali metal hydroxide has been obtained. The anolyte withdrawn can be recirculated to the same anode compartment or brought to another anode compartment. Suitably two or more cells are connected in a stack, in which the anolyte and catholyte flow through the anode and cathode compartments, respectively. The cells can be connected in parallel, in series or combinations thereof, so-called cascade connections. Preferably, use is made of a stack of two or more cells equipped with hydrogen depolarizing anodes combined with a conventional oxygen or chlorine liberating anode. Such a stack combines energy efficiency with a high degree of chloride ion removal.

The use of a membrane in the electrochemical cell, makes it possible to produce purer products and with less energy than with a diaphragm. The main drawback is the sensitivity to impurities. However, in the present process a suitable combination of purification methods can be used to eliminate this problem. Therefore, the electrochemical cell is suitably equipped with a membrane.

The membrane used in the electrochemical cell of the present invention can be homogeneous or heterogeneous, organic or inorganic. Furthermore, the membrane can be of the molecular screen type, the ion-exchange type or salt bridge type. The cell is suitably equipped with a membrane of the ion-exchange type.

The membranes of the ion-exchange type can be cationic or anionic. The use of a cation exchange membrane makes it possible to produce pure alkali metal hydroxide in the cathode compartment. Since very pure alkali metal hydroxide is a highly desirable product, it is suitable that the electrolysis is carried out in an electrochemical cell equipped with a cation exchange membrane. An essentially chlorine-free mixture of concentrated sulphuric acid and sodium sulphate can be produced in the anode compartment, if the formation of chlorine is enhanced. If the formation of chlorine is suppressed, the acid mixture will also contain hydrochloric acid.

An anion exchange membrane can be inserted between the cation exchange membrane and the anode, thereby creating one type of a three-compartment cell. By feeding the aqueous solution of precipitator dust to the intermediate compartment and applying voltage, purer alkali metal hydroxide can be produced in the cathode compartment. Dilute sulphuric acid with a low content of chloride ions can be produced in the anode compartment if the formation of chlorine is enhanced, since the sulphate ions migrate through the anion exchange membrane. In the intermediate compartment, the solution withdrawn will be depleted in alkali metal sulphate.

The cell can also be equipped with bipolar membranes between the anode and cathode. The bipolar membranes can be used in a cell construction, where the anion and cation exchange membranes are positioned between bipolar membranes and where an anode and cathode are positioned at the cell ends.

The electrodes can be e.g. of the gas diffusion or porous net type or plane-parallel plates. The electrodes can be passive or activated to enhance the reactivity at the electrode surface. It is preferred to use activated electrodes.

A cathode with a low hydrogen overpotential is necessary for an energy efficient process. The material of the cathode may be steel or nickel, suitably nickel and preferably activated nickel.

An anode with a low chlorine and high oxygen overpotential is suitably used in the production of chlorine. For production of hydrochloric acid, an anode with low overpotential for the oxygen evolution reaction is preferred. Suitable anodes for the desired product, can be obtained by combining suitable anode base materials with suitable anode coating materials. Suitable materials for the anode base are materials stable in the anolyte, e.g. lead or tantalum, zirconium, hafnium, niobium, titanium, or combinations thereof. Suitable materials for the anode coating are one or more oxides of lead, tin, ruthenium, tantalum, iridium, platinum or palladium. Examples of suitable anodes are dimensionally stable anodes sold by Permascand AB of Sweden, e.g. DSA® and DSA® $O_2$. Also, anodes based on carbon can be used.

In the production of hydrochloric acid, use is suitably made of electrochemical cells where hydrogen gas is used to produce protons in the anolyte by way of a hydrogen depolarized anode. An example of a suitable cell equipped with such a hydrogen depolarized anode is Hydrina® sold by De Nora Permelec of Italy. Also in the production of an essentially chloride-free anolyte, a cell equipped with a hydrogen depolarized anode can be used. In this case however, the anolyte must be pretreated in a first cell to reduce the content of chloride by production of chlorine.

Generally, the temperature in the anolyte can be in the range from about 50° up to about 100° C., suitably in the range from 55° up to 90° C. and preferably in the range from 60° up to 80° C. With titanium anodes, the corrosion rate is very dependent on the combination of temperature, pH and concentration of chloride ions in the anolyte. Thus, if the anolyte contains about 4 g chloride/l the pH should be above about 1–2 at 70° C. By reducing the temperature, the allowable chloride concentration can be increased and the pH becomes less important.

The current density can be in the range from about 1 up to about 10 $kA/m^2$, suitably in the range from 1.5 up to 6 $kA/m^2$ and preferably in the range from 2 up to ∝1 $kA/m^2$.

The concentration of sulphuric acid produced as well as the current efficiency of the present process can be markedly increased by adding crystalline sodium sulphate to the aqueous solution before the electrolysis. The crystalline sodium sulphate is suitably added after the acidification step. The sodium sulphate relates to all kinds of known sodium sulphate and in any mixture. Suitable crystalline sodium sulphate is obtained in the production of chlorine dioxide, preferably in low pressure generating processes. The current efficiency should be maintained above about 50%. The current efficiency is suitably maintained in the range from 55 up to 100% and preferably in the range from 65 up to 100%.

The chlorine produced can be used in all types of chemical processes, where chlorine is required. For example, the chlorine can be used for bleaching pulp produced in the pulp mill where the precipitator dust is obtained.

Anolyte containing sulphuric acid produced in the electrochemical cell under conditions such that most of the chloride is reacted to chlorine can be advantageously used to regulate the pH in various parts of a pulp or paper mill, e.g. for acidifying a pulp slurry before ozone bleaching or precipitating dissolved organic materials in various liquors of the mill. Preferably, at least a portion of the anolyte containing sulphuric acid with a low content of hydrochloric acid is used in the mill where the precipitator dust is obtained. Spent liquors containing such sulphuric acid with a low content of hydrochloric acid can be recycled to the recovery system or brought to a subsequent electrolysis step for production of acid and alkali metal hydroxide of higher concentration.

Sulphuric acid produced in the electrochemical cell under conditions such that a considerable amount of the chloride is converted to hydrochloric acid, is advantageously used where the presence of chloride is preferable or at least tolerable. To avoid an increase in chloride content in the recovery system, it is preferred that spent liquors containing such chloride-rich sulphuric acid are taken care of outside the pulping chemical recovery system. For example, chloride-rich sulphuric acid can be used in the bleach plant of the pulp mill, provided that the spent bleach liquor is treated separately. Mixtures of hydrochloric acid and sulphuric acid can be used in tall oil splitting and for pickling metals. A portion of the flow of anolyte withdrawn from the cell containing a mixture of sulphuric acid and sodium sulphate, can be used in the production of chlorine dioxide, suitably in a low pressure chlorine dioxide process.

The catholyte containing alkali metal hydroxide can be advantageously used to regulate the pH in various parts of a pulp or paper mill, e.g. for preparing cooking and alkaline extraction liquors for lignocellulose-containing material. Suitably, at least a portion of the catholyte containing alkali metal hydroxide is used in the mill where the precipitator dust is obtained. Preferably, at least a portion of the catholyte withdrawn from the electrochemical cell is used for adjusting the pH of the aqueous solution of precipitator dust in the present process.

BRIEF DESCRIPTION OF THE DRAWING

The process of the present invention will now be described in more detail with reference to FIG. 1.

Figure 1:
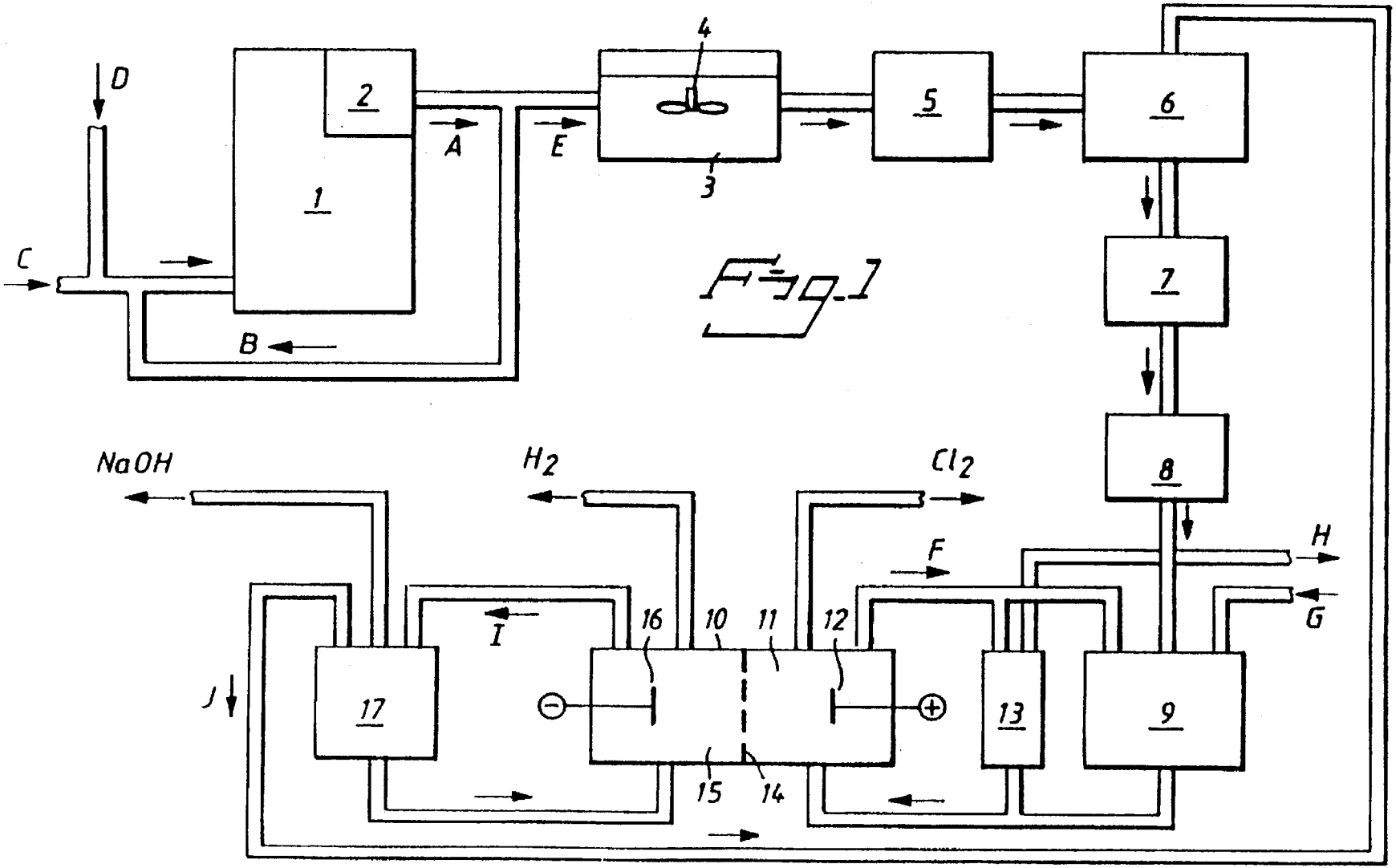
FIG. 1 shows a schematic description of an electrochemical plant to produce chlorine from precipitator dust.

Dust formed in a recovery boiler (1) is collected in a dry-bottom electrostatic precipitator (2). The dust collected is withdrawn (A) from the boiler. A portion of said dust is recycled (B) to the flow of spent liquor (C) to be burned in the recovery boiler. Pulping chemicals are added (D) to make up for the losses in the cooking and recovery system. A portion of the dust collected is withdrawn (E) from the recovery system and dissolved in water in a tank (3) equipped with a stirrer (4). The concentration of dust in the aqueous solution is about 30 percent by weight. The aqueous solution is brought to a first vacuum drum filter (5), where undissolved substances are separated off. The filtered aqueous solution is brought to a tank (6) where the pH is adjusted to about 12, to precipitate inorganic substances. The pH is adjusted by adding catholyte containing sodium hydroxide produced in the electrochemical cell (10). The pH-adjusted aqueous solution is brought to a second vacuum drum filter (7), where precipitated and flocculated substances are separated off. The filtered aqueous solution is subsequently brought to a cation exchanger (8), to further reduce the content of multivalent cations and especially divalent ones. The cation exchanged aqueous solution is brought to a tank (9) where the content of carbonate and carbon dioxide are reduced by acidification. The pH in (9) is regulated to about 6.5 by recirculating acid anolyte (F) from the two-compartment electrochemical cell (10). In the tank (9), the temperature is about 70° C. and the pressure slightly below atmospheric. Make-up water is added (G) to make up for the water split during electrolysis. The acid aqueous solution is brought to the anode compartment (11) of the cell, where the temperature is regulated to about 70° C. The current density is about 1.5 $kA/m^2$. Chlorine is formed on a DSA anode (12) and withdrawn through a gas vent. A mixture of sulphuric acid and sodium bisulphate is also formed in the anode compartment. This anolyte mixture is withdrawn (F) from the top of the cell and a portion is brought to the tank for liberation of carbon dioxide (9). The major portion of the anolyte mixture is recirculated directly to the anode compartment by way of an anolyte recirculation tank (13). When the concentration of sulphuric acid is sufficient a portion of anolyte can be withdrawn (E) from (23).

The anode and cathode compartment of the cell can be separated by a Nafion 324 or Nafion 550 cation exchange membrane (14). Sodium hydroxide and hydrogen gas are formed in the cathode compartment of the cell (15). The cathode (16) is an activated nickel cathode. The hydrogen gas is withdrawn through a gas vent, while the catholyte is withdrawn (I) at the top of the cell. The major portion is recirculated directly to the cathode compartment of the cell (15) by way of a catholyte recirculation tank (17), to increase the concentration of hydroxide. When the concentration of hydroxide is sufficient, suitably in the range from 100 up to 200 g/liter, a portion of the catholyte can be withdrawn from the cell to be used for pH regulation outside the present process. Another portion of the catholyte can be withdrawn (J) and used in (6).

The invention and its advantages are illustrated in more detail by the following examples which, however, are only intended to illustrate the invention and not to limit the same. The percentages and parts used in the description, claims and examples, refer to percentages by weight and parts by weight, unless otherwise specified.

EXAMPLE 1

Precipitator dust was withdrawn from a kraft recovery boiler, dissolved in water, the pH of the resulting aqueous solution adjusted to about 12 and the undissolved or precipitated substances separated-off by filtration. The concentration of various compounds in the aqueous solution before and after adjusting the pH followed by separation is shown in Table I.

TABLE I

| | Concentration, mg/l | | |
|---|---|---|---|
| Compound | Before adjust. | After adjust. | Reduction, % |
| Calcium | 28 | 21 | 25 |
| Magnesium | 11 | 0.05 | 99 |
| Manganese | 5.8 | 0.05 | 99 |
| Barium | 0.35 | 0.2 | 43 |
| Iron | 0.2 | 0.14 | 30 |
| Nickel | 0.2 | 0.1 | 50 |

As is evident from Table I, especially magnesium and manganese can be efficiently separated off by adjusting the pH to above about 10.

EXAMPLE 2

Precipitator dust containing 2.9 percent by weight of sodium chloride, was withdrawn from a kraft recovery boiler and electrolysed in a laboratory cell to produce chlorine. The dust was dissolved in deionized water at 50° C. After dissolving, the concentration of dust in the aqueous solution was 30 percent by weight. The aqueous solution was filtered, to remove undissolved particles. The pH was raised to 12–13 by addition of sodium hydroxide, to precipitate inorganic impurities. The aqueous solution was again filtered, to remove precipitated or flocculated impurities.

The experiment was carried out in a two-compartment flow-through cell set-up with an electrolyte volume of 2.4 liter on the anode side as well as the cathode side of the cell. The cell was equipped with a turbulence promotor between the anode and Nafion 324 cation exchange membrane. A DSA®-$O_2$ anode of titanium and a cathode of nickel were used. The electrode area was 1 $dm^2$ and the electrode gap was 16 mm. The cell was operated at a temperature of about 65° C., with a current density of about 3 $kA/m^2$. The flow rates through the anode and cathode compartments were about 0.1 m/s.

The concentration of sodium hydroxide in the catholyte was kept constant at 150 g/liter, i.e. 3.75 mol/liter, by feeding deionized water and bleeding hydroxide produced. The concentration of sodium hydrogen sulphate in the anolyte produced, was about 4 mol/liter corresponding to 200 g/liter of sulphuric acid.

The concentration of chloride ions in the aqueous solution was initially 247 mmol/liter. Every 30 minutes, 250 ml of anolyte were withdrawn and 250 ml of alkalized aqueous solution were added. During 30 minutes, 100 mmol chloride corresponding to 3.5 g chloride were removed as chlorine. Thus, after 7 hours of electrolysis a total amount of 1400 mmol corresponding to 49 g chloride had been removed as chlorine. At the end of experiment, the concentration of chloride ions in the aqueous solution had dropped to 50 mmol/liter.

The share of potassium ions of the total amount of potassium and sodium ions in the aqueous solution fed to the electrochemical cell, was 22%. At the end of the experiment 4% of the potassium was present in the alkali metal hydroxide and the remaining 18% in the acid anolyte.

EXAMPLE 3

Precipitator dust containing 0.2 percent by weight of sodium chloride, was withdrawn from a kraft recovery boiler and electrolysed in a laboratory cell to produce chlorine. The process conditions were the same as the ones described in Example 2.

The concentration of chloride ions in the aqueous solution was initially 17 mmol/liter. Every 30 minutes, 250 ml of anolyte were withdrawn and 250 ml of alkalized aqueous solution were added. During 30 minutes, 5 mmol chloride corresponding to 18 g chloride were removed as chlorine. After 6 hours of electrolysis, the concentration of chloride ions in the aqueous solution had dropped to 5 mmol/liter.

EXAMPLE 4

An aqueous precipitator dust solution containing about 1 mol/liter of sulphuric acid, 1.5 mol/liter of sodium sulphate, 250 mmol/liter of potassium sulphate and 460 mmol/liter of sodium chloride, was electrolyzed in the same cell and under same conditions as described in Example 2, except that the pH in the anolyte was kept constant by addition of sodium hydroxide. At a current efficiency of 53% for the formation of chlorine, the concentration of chloride ions in the aqueous solution was decreased to 166 mmol/liter, i.e. a reduction in chloride content of 64%.

EXAMPLE 5

An aqueous precipitator dust solution containing about 1 mol/liter of sulphuric acid, 1.5 mol/liter of sodium sulphate, 250 mmol/liter of potassium sulphate and 438 mmol/liter of sodium chloride, was electrolyzed in the same cell and under same conditions as described in Example 2, except that the current density was 1.0 $kA/m^2$. The pH in the anolyte was kept constant in accordance to Example 4. The concentration of chloride ions in the aqueous solution was decreased to 224 mmol/liter, i.e. a reduction in chloride content of 50.8%, at a current efficiency of 88% for the formation of chlorine. The experiment was continued until the concentration of chloride ions in the solution had dropped to 9.5 mmol/liter, i.e. a reduction in chloride content of 98.3%. The overall current efficiency was 37.9% for the formation of chlorine.

We claim:

1. A process for reducing the content of chloride in a recovery system for pulping chemicals containing sulphur and an alkali metal, comprising the steps of:

(a) bringing a spent liquor generated from a pulping step to a recovery boiler, (b) burning said spent liquor optionally together with make-up chemicals, (c) collecting precipitator dust formed and withdrawing said precipitator dust from the precipitator of the recovery boiler, (d) dissolving at least a portion of the precipitator dust in water to produce an aqueous solution of precipitator dust, (e) adjusting the pH of said aqueous solution of precipitator dust to a pH about 10 or above to precipitate inorganic substances, wherein flocculated or undissolved inorganic and organic substances are separated from said aqueous solution, and (f) electrolyzing said pH-adjusted aqueous solution of precipitator dust in a membrane electrochemical cell containing at least two compartments for production of chlorine or hydrochloric acid in the anode compartment and alkali metal hydroxide in the cathode compartment.

2. A process according to claim 1, wherein at least a portion of the catholyte withdrawn from the electrochemical cell is used to adjust the pH of the aqueous solution to precipitate inorganic substances.

3. A process according to claim 1, wherein the aqueous solution of precipitator dust is acidified before the electrolysis to reduce the content of carbonate or carbon dioxide in said aqueous solution.

4. A process according to claim 3, wherein the aqueous solution is acidified with anolyte withdrawn from the electrochemical cell.

5. A process according to claim 1, wherein the electrochemical cell is equipped with a cation exchange membrane.

6. A process according to claim 1, wherein the aqueous solution is electrolysed in a three-compartment electrochemical cell.

7. A process according to claim 1, wherein the aqueous solution is electrolysed in an electrochemical flow-through cell.

8. A process according to claim 1, wherein the aqueous solution of precipitator dust is cation exchanged before the electrolysis to reduce the content of in organic impurities.

9. A process according to claim 1, wherein the recovery system for pulping chemicals containing sulphur and an alkali metal, is a sulphate recovery system.

10. A process according to claim 1, wherein at least a portion of the anolyte produced in the electrochemical cell is used in the mill where the precipitator dust is obtained.

* * * * *